US011156040B2

(12) United States Patent
Jostes et al.

(10) Patent No.: US 11,156,040 B2
(45) Date of Patent: Oct. 26, 2021

(54) GROUND DRILLING DEVICE, SYSTEM COMPRISING A GROUND DRILLING DEVICE, METHOD FOR EARTH DRILLING AND USE OF A GROUND DRILLING DEVICE

(71) Applicant: TRACTO-TECHNIK GmbH & Co. KG, Lennestadt (DE)

(72) Inventors: Lucas Jostes, Finnentrop (DE); Stefan Hermes, Lennestadt (DE); Dieter Wurm, Kirchhundem (DE); Sebastian Fischer, Lennestadt (DE); Andreas Joachim Hanses, Kirchhundem (DE); Lars Rosenthal, Lennestadt (DE); Markus Hamers, Lennestadt (DE); Thomas Himmelreich, Schmallenberg (DE); Manuel Pohl, Lennestadt (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 0 days.

(21) Appl. No.: 16/786,306

(22) Filed: Feb. 10, 2020

(65) Prior Publication Data

US 2020/0284108 A1 Sep. 10, 2020

(30) Foreign Application Priority Data

Feb. 20, 2019 (DE) ..... 10 2019 001 203.8

(51) Int. Cl.
*E21B 19/20* (2006.01)
*E21B 19/15* (2006.01)

(52) U.S. Cl.
CPC ..... *E21B 19/20* (2013.01); *E21B 19/15* (2013.01)

(58) Field of Classification Search
CPC ..... E21B 19/20; E21B 19/15; E21B 7/046; E21B 7/02
USPC ..... 175/52
See application file for complete search history.

(56) References Cited

U.S. PATENT DOCUMENTS 5,263,545 A * 11/1993 Tudora ..... E21B 6/00 175/52
6,408,954 B1 * 6/2002 Price ..... E21B 19/15 175/52
7,694,751 B2 * 4/2010 Hartke ..... E21B 7/046 175/52
9,523,249 B2 * 12/2016 Binder ..... E21B 19/14
(Continued)

FOREIGN PATENT DOCUMENTS

CA 2 419 885 A1 8/2003
DE 10 2009 035 277 A1 2/2011
DE 11 2013 002 136 T5 1/2015
(Continued)

*Primary Examiner* — Lynn E Schwenning
(74) *Attorney, Agent, or Firm* — Howard IP Law Group, PC

(57) ABSTRACT

A ground drilling device having a drilling carriage, which defines a drill string axis, a first drill rod magazine for a plurality of rod sections and a transfer device for the transfer of a rod section between the first drill rod magazine and a position of the rod section along the drill string axis, wherein at least a first connection element is arranged at the first rod magazine and/or at the drilling carriage for the connecting of the first rod magazine to a second rod magazine such that the second rod magazine is arranged next to the first rod magazine.

20 Claims, 2 Drawing Sheets

(56) References Cited

U.S. PATENT DOCUMENTS

| | | | | |
|---|---|---|---|---|
| 2002/0014352 | A1* | 2/2002 | Rust | E21B 7/046 175/19 |
| 2007/0092358 | A1* | 4/2007 | Innes | E21B 19/155 414/22.51 |

FOREIGN PATENT DOCUMENTS

| | | | |
|---|---|---|---|
| DE | 202016008527 | U1 | 6/2018 |
| EP | 0919692 | A2 | 6/1999 |
| EP | 2803810 | A1 | 11/2014 |
| WO | 2011/120627 | A2 | 10/2011 |

* cited by examiner

GROUND DRILLING DEVICE, SYSTEM COMPRISING A GROUND DRILLING DEVICE, METHOD FOR EARTH DRILLING AND USE OF A GROUND DRILLING DEVICE

FIELD OF INVENTION

The invention relates to a ground drilling device, a system comprising a ground drilling device, a method for earth drilling and a use of a ground drilling device.

BACKGROUND

From DE 10 2009 035 277 A1 there is known a drilling device, comprising a drill rod magazine with a plurality of rod sections stored therein, a drilling carriage, as well as a transfer device, with which the rod sections can be removed from the drill rod magazine and be positioned in the drilling carriage. The drill rod magazine is positioned next to a base support of the drilling carriage. The drill rod magazine has the shape of a cuboid and is composed of a plurality of interconnected frame profiles. At the top end of the drill rod magazine the magazine has an open configuration, so that the transfer device can reach into the drill rod magazine and remove a rod section. The transfer device is connected by a carrier frame to both an outer wall of the drill rod magazine and the base support of the drilling carriage. Horizontally oriented racks are present on the carrier frame, meshing together with driving gears of a drive. A gripping unit of the transfer device can be moved along the horizontal racks in the horizontal direction.

SUMMARY

It has been discovered that, while the known drilling devices achieve good results, the situation may occur in an earth drilling being performed that the number of rod sections kept on hand originally in the rod magazine is not enough and further rod sections have to be added to the rod magazine.

Now, the problem which the invention proposes to solve is to provide a ground drilling device, a system comprising a ground drilling device, a method for earth drilling and a use of a ground drilling device in which a simple designed ground drilling device can be used and a more flexible handling is made possible, particularly if it should be discovered that the number of rod sections kept on hand originally in the rod magazine is not enough for the completion of the earth drilling.

The key idea of the invention is to provide an additional or second rod magazine next to the actual rod magazine of the ground drilling device, which can be arranged optionally next to the first or original rod magazine. In this way, the actual or original rod magazine need not be further filled, particularly by hand, but instead an additional already filled rod magazine can be used, which can be arranged next to the original rod magazine.

The inventors have broken with the idea that the rod magazine, which is originally filled with rod sections, needs to be further filled with rod sections in order to continue with the earth drilling. Instead of this, they propose arranging an additional or second rod magazine alongside the rod magazine, being filled with additional rod sections, with which the earth drilling can then be brought to completion. The simple providing of an additional rod magazine, which may itself be replaced if necessary, was not previously taken into consideration, since the movement of the transfer device, which moves the rod section from the first rod magazine into a position of the rod section along the drill string axis, on the first rod magazine was limited. Furthermore, there were probably concerns on account of the not insignificant weight of an additional rod magazine—and also one alongside the first rod magazine. Such a weight might impair the stability. By means of multiple "second" rod magazines which can be used in succession and which can be connected in succession to the first rod magazine, a longer earth drilling can be accomplished without a subsequent manual refilling.

The invention creates a ground drilling device with a drilling carriage, which defines a drill string axis. The ground drilling device comprises a first drill rod magazine for a plurality of rod sections and a transfer device for the transfer of a rod section between the first drill rod magazine and a position of the rod section along the drill string axis. A guide for a movement of the transfer device is present on the drill rod magazine. At least a first connection element is arranged at the first rod magazine and/or at the drilling carriage for the connecting of the first rod magazine to a second rod magazine such that the second rod magazine is arranged next to the first rod magazine.

The term "ground drilling device" encompasses in the sense of the specification any device which moves in particular a drill string having rod sections in an existing or yet to be created conduit in the soil, in order to create or widen a borehole, particularly a horizontal borehole (HD), or to draw pipelines or other long bodies into the soil. The ground drilling device may be in particular a HD device. A ground drilling device may be a device driving forward a drill string, which can work in particular by soil displacement, and place the drill string into the soil by translatory and/or rotatory movement in the lengthwise axial direction of the drill string. A borehole may be placed in the soil by applying pulling or pushing to the drill string.

The term "soil" encompasses in the sense of the present specification in particular any kind of material, particularly dirt, sand and/or rock, in which existing or yet to be created conduits or boreholes can be made, preferably being horizontal at least for a portion.

The term "drilling carriage" encompasses a frame, particularly a movable frame, on which a carriage can be provided for moving the drill string, which can move back and forth in the direction of the drill string axis in order to move the drill string in the soil by pushing or pulling. The drilling carriage generally comprises at least the carriage and/or a linear drive for advancement of the drill string. The linear drive may additionally or alternatively comprise a rotation drive for the rotational driving of the drill string. The drilling carriage can moreover comprise one or more clamping devices, by which the drill string or a rod section being attached can be secured. It may be provided that a clamping device is provided on the drilling carriage, by means of which the free end of the drill string can be secured, in order to make possible a connecting of a newly attached rod section to the already introduced drill string.

The term "drill string axis" means in particular the axis formed by the longitudinal axes of the individual rod sections of the drill string, considering the longitudinal axes of the rod sections which are situated in the near region of the ground drilling device in the drill string, particularly the last and/or next to last rod section in the drill string, whose longitudinal axis can be provided by the drive element engaging with the last rod section. Basically, the drill string axis is defined by the drilling carriage on which the sled can move, moving together with a holder in which a rod section can be placed in order to connect the rod section to the introduced drill string.

The term "drill string" in the sense of the invention encompasses any means which can be introduced into the soil in order to make a borehole in the soil. In particular, the drill string may comprise a rod, a chain, and/or a cable. The term "drill string" encompasses in the sense of the specification not only rigid, individual drill strings having rod sections connected directly or indirectly to each other, but also in particular any force transmitting elements which can be used in a ground drilling device. Moreover, the drill string comprises at one end, particularly the front end, a drilling head and optionally a drilling head tip or a region adjacent to the drilling head, which may have in particular the same orientation as the drilling head. In a particularly preferred embodiment, it is proposed to design a front end segment of a drill string as a drilling head or drilling tool.

The term "transfer device" in the sense of the specification encompasses a device for grasping a rod section, particularly by means of one or more gripping devices. The transfer device has the ability to move the at least one gripping device, by means of which a rod section, particularly one in the drill rod magazine, can be picked up or grasped and moved into a position in the direction of the drill string axis. It may also be possible for the transfer device to move a rod section from a position in the direction of the drill string axis into the drill rod magazine, for example when the drill string is being pulled out from the soil. The at least one gripping device can be moved vertically and horizontally, both transversely to and in the longitudinal direction, parallel to the drill string axis. The transfer device may be designed in particular like the transfer device known from DE 10 2009 035 277 A1.

In one preferred embodiment, a guide can be present at the first rod magazine for a movement of the transfer device. In the sense of the specification, the term "guide" encompasses one or more structural elements along which another structural element—here, the transfer device—can be moved. A guide dictates the direction of movement and may serve in particular as a support. The guide may comprise one or more rails, which is or are oriented in particular transversely to the drill string axis. The guide may be designed as one or more profiled rails. The guide(s) may be embraced by the transfer device. The guide(s) may be designed as an open profile without the transfer device completely surrounding the guide(s). The guide may be designed as a linear guide. The transfer device can be moved in the guide by means of sliding pieces, rollers, or the like.

A "rod magazine" in the sense of the specification encompasses in particular a magazine having two end elements or head pieces, on which separating elements are provided. The separating elements may be oriented toward each other in particular, so as to dictate a partitioning or compartments or rows of the rod sections in the drill rod magazine. The term "rod magazine" in the sense of the specification also encompasses a string as is known from DE 10 2009 035 277 A1.

In one preferred embodiment, the guide is designed for a movement of the transfer device transversely to the drill string axis. In this way, the first rod magazine can be arranged next to the drilling carriage. A simple transfer or handover from the first rod magazine to the drill string axis is possible. A rotation and/or a moving of the rod section along the drill string axis can be reduced.

In one preferred embodiment, the transfer device comprises two gripping devices for grasping a rod section. In this way, a secure handling by means of the transfer device can be accomplished. A smooth transfer is possible. The gripping devices may be arranged at a spacing from each other in the direction of the drill string axis. In particular, the gripping device can have a fixed angle relative to the drill string axis, so that in particular rod sections lying substantially parallel to the drill string axis can be easily grasped.

In one preferred embodiment, the transfer device is designed to be moved transversely to the drill string axis across the second rod magazine. In particular, the transfer device can be "enabled" to move beyond the original limitation of its movement, which was dictated by the first rod magazine or the guide on the first rod magazine. A mechanical and/or electrical or electronic enabling can occur, making it possible for the transfer device to also move across the second rod magazine, and transversely to it. In particular, the guide which is formed on the first rod magazine may be continued, particularly seamlessly, on the second rod magazine. As regards the movement of the transfer device, a guide designed with substantially no interruption can be formed across the first and second rod magazine. The first rod magazine and the second rod magazine may orient the second rod magazine to the first rod magazine as regards the connection by means of the at least one first connection element so that a guide for the transfer device extends substantially without a gap across the first rod magazine to the second rod magazine transversely to the drill string axis, by means of which the transfer device can be moved across the first and the second rod magazine to reach the rod sections contained therein.

An enabling of the transfer device in regard to a limitation of the movement that was provided substantially by the width of the first rod magazine can be accomplished mechanically by removal of stop elements or the like (serving for safety purposes) and/or prolonging the electrically or electronically dictated travel of the transfer device across the second rod magazine up to its lateral end region. The transfer device may have a path measuring device to detect the path traveled by the transfer device.

The first connection element or the first connection elements can indicate by their position a reference position or reference positions, making possible a connecting of the second rod magazine to the first rod magazine in such a way that the second rod magazine can be arranged with respect to the first rod magazine so that the transfer device can reach the rod sections located in the second rod magazine—possibly after an "enabling" of the movement.

Insofar as it is stated that the first connection element or the first connection elements can also be formed on the drilling carriage, this takes account of the fact that the second rod magazine may also be connected indirectly via the drilling carriage to the first rod magazine. The connection of the first rod magazine to the second rod magazine also encompasses a functional meaning whereby the second rod magazine needs to be connected to the first rod magazine in order for the transfer device to also reach the second rod magazine. Accordingly, the first and the second rod magazine may also be joined together indirectly via the drilling carriage by means of one or more connection elements arranged on the drilling carriage.

In one preferred embodiment, more than one connection element is formed at the first rod magazine. In one particularly preferred embodiment, one connection element is formed at each head piece or end face element of the first rod magazine. An arrangement of the first connection elements at the head pieces or the end face elements extending alongside the first rod magazine in the direction of the longitudinal axis of the first rod magazine is preferable here. In this way, the second rod magazine can be mounted at the ends In one preferred embodiment, the first connection element is chosen from the group of the following elements with which a mechanical connection can be produced: holder, recess, protrusion, bar, hook, bolt, bracket or the like.

In one preferred embodiment, the first rod magazine comprises two head pieces extending transversely to the longitudinal direction of the carriage, on each of which at least one guide for the transfer device is arranged. The guide can be connected directly to a head piece. The guide may be connected directly to the head piece at the top of the head piece. In this way, a simple design of the first rod magazine as a guide can be used. The orientation of the first rod magazine with the head pieces can be simplified for the orienting of the transfer device or the gripping device of the transfer device. The transfer device can be used for the stabilization in the longitudinal direction of the first rod magazine. A mutual stabilization is possible. It may also be provided that the head pieces are screwed and/or welded to the drilling carriage without providing a direct stabilization by means of the transfer device, for example when the guide(s) are designed as an open profile.

In one preferred embodiment, the head pieces are designed so that they can be connected separately to the drilling carriage. A transport of the first rod magazine is simplified, comprising basically the two head pieces with the separating elements arranged thereon. The simplification involves both the spatial extension of the first rod magazine and the material used for the first rod magazine. No frame need be used, which is more difficult to handle than the two individual head pieces. A rod magazine comprising a circumferential frame, at least for a portion, is not precluded.

In one preferred embodiment, the first rod magazine is designed with no connection struts between the two head pieces, i.e., no connection struts need to be provided to join the head pieces together. Material can be economized in this way. The two head pieces can be handled independently of each other. A stabilization can be accomplished in particular by the transfer device, which is connected to the two head pieces, each of the head pieces having a guide or being able to be connected to a guide. A first rod magazine designed with no connection struts between the two head pieces was not considered to be possible prior to the present invention. In addition to the misconception that a framelike construction of the rod magazine must necessarily be present, the inventors of the present application have discovered that even in such a situation a second or additional rod magazine can be provided.

In one preferred embodiment, multiple separating elements are arranged on the head pieces, being staggered and extending along the drill string axis. The offset is chosen substantially such that the separating elements extend substantially parallel along the drill string axis. The length by which the separating elements are staggered along the drill string axis is less than half the length of the rod sections. The length of the separating elements is preferably less than a third of the length of the rod sections, particularly preferably less than a quarter of the length of the rod sections, particularly preferably less than a fifth of the length of the rod sections, particularly preferably less than a sixth of the length of the rod sections, most particularly preferably less than a seventh of the length of the rod sections. In this way, material can be economized, and furthermore a clear separation is formed for the compartments of the individual rod sections. Weight and material can be economized.

The invention also creates a system with a ground drilling device as specified above. Moreover, the system also comprises a second rod magazine.

The second rod magazine may have in particular a framelike construction, where at least one frame is present as a base structure in order to move the second rod magazine as a whole together with the rod sections contained therein. The second rod magazine may be moved by a crane, for example, in order to connect the second rod magazine to the first rod magazine. In particular, the second rod magazine has a side wall on each of its long sides, which may comprise openings, for example in order to reduce the weight of the second rod magazine and/or to save on material for the second rod magazine. Moreover, the openings can give access to the rod sections arranged therein, for example in order to clean and/or flush the rod sections with a high-pressure cleaner.

In one preferred embodiment, the second rod magazine has a spatial extension transversely to the longitudinal axis allowing a holding of one or two rod sections next to each other. This can ensure that, when the second rod magazine is connected to the first rod magazine, an unfavorable shifting of the center of gravity of the ground drilling device does not occur. The inventors have discovered that the presence of only one or two columns of rod sections in the second rod magazine may be sufficient to complete an earth drilling when slight deviations in the planning have resulted in an increased number of rod sections needed. Accordingly, the second rod magazine may have only one column of rod sections, so that the rod magazine does not need to have any separating elements. Only one separating element is needed if two columns of rod sections are provided next to each other.

In one preferred embodiment, the second rod magazine comprises a second connection element for a mechanical interaction with the first connection element. In this way, besides providing a connection element on the first rod magazine and/or on the drilling carriage, a second reference point or a second reference range can be formed on the second rod magazine. The second reference range can interact with a first reference range, formed by the first connection element or elements, in order to orient the second rod magazine to the first rod magazine. A defined reference point or reference ranges help to minimize errors.

In particular, the second rod magazine can be connected to the first rod magazine in such a way that the rod sections stockpiled in the second rod magazine are arranged offset in parallel from any rod sections present in the first rod magazine. In this way, the second rod magazine can be a virtual extension of the first rod magazine. When the transfer device is enabled in the movement across the second rod magazine, a control device for the transfer device can be told how far the transfer device needs to move transversely to the drill string axis in order to be arranged above a rod section in the second rod magazine. Alternatively and/or additionally, a control system of the transfer device may be designed such that a command or menu item "additional rod magazine present" can be selected, with which the necessary movements or movement coordinates are relayed to the transfer device in order to reach the rod sections of the second rod magazine. By means of a possible standardization of the second rod magazine, a control device of the transfer device can be told whether and which second rod magazine is to be used. An operator then need only select which kind of a second rod magazine is used.

In one preferred embodiment, the system comprises a crane for moving the second rod magazine. Due to the possibly smaller configuration of the second rod magazine as compared to the first rod magazine, a relatively small crane is sufficient to connect the second rod magazine to the first rod magazine.

The invention also creates a method for earth drilling with a ground drilling device. The method involves the step of an arranging of a second rod magazine next to a first rod magazine.

The invention also creates a use of a ground drilling device for earth drilling, wherein a ground drilling device is used, having a drilling carriage, which defines a drill string axis. Moreover, a first drill rod magazine for a plurality of rod sections and a transfer device for the transfer of a rod section between the first drill rod magazine and a position of the rod section along the drill string axis are used. Furthermore, a second rod magazine is used, which can be arranged next to the first rod magazine.

The term "comprise" in the sense of the specification encompasses both the inherent meaning of the term, that further elements may be provided besides the elements mentioned (a non-exhaustive listing), but also the meaning that the term "comprise" is used synonymously with "consist of" and "formed from".

The term "a" or "an", particularly in the usage "a connection element", encompasses in the sense of the specification an indeterminate number of the elements preceded by the term "a". But it may also happen that the term "a" can be understood in the sense of a specific numeral, so that only one of the elements preceded by the term "a" may be present.

The aspects of the system, the method and the use of the ground drilling device apply analogously to the remarks on the aspect of the ground drilling device itself. The resulting design and configuration of the ground drilling device may also be reflected in the features of the aspect of the system, the method, and the use, so that corresponding remarks about the aspects of the system, the method, and the use will emerge from the remarks on the aspect of the ground drilling device.

The preceding remarks, just as the following description of exemplary embodiments, do not constitute any abandonment of particular embodiments or features.

BRIEF DESCRIPTION OF DRAWINGS

The invention shall now be explained more closely with the aid of an exemplary embodiment presented in the drawing.

The drawings show.

DETAILED DESCRIPTION

Figure 1:
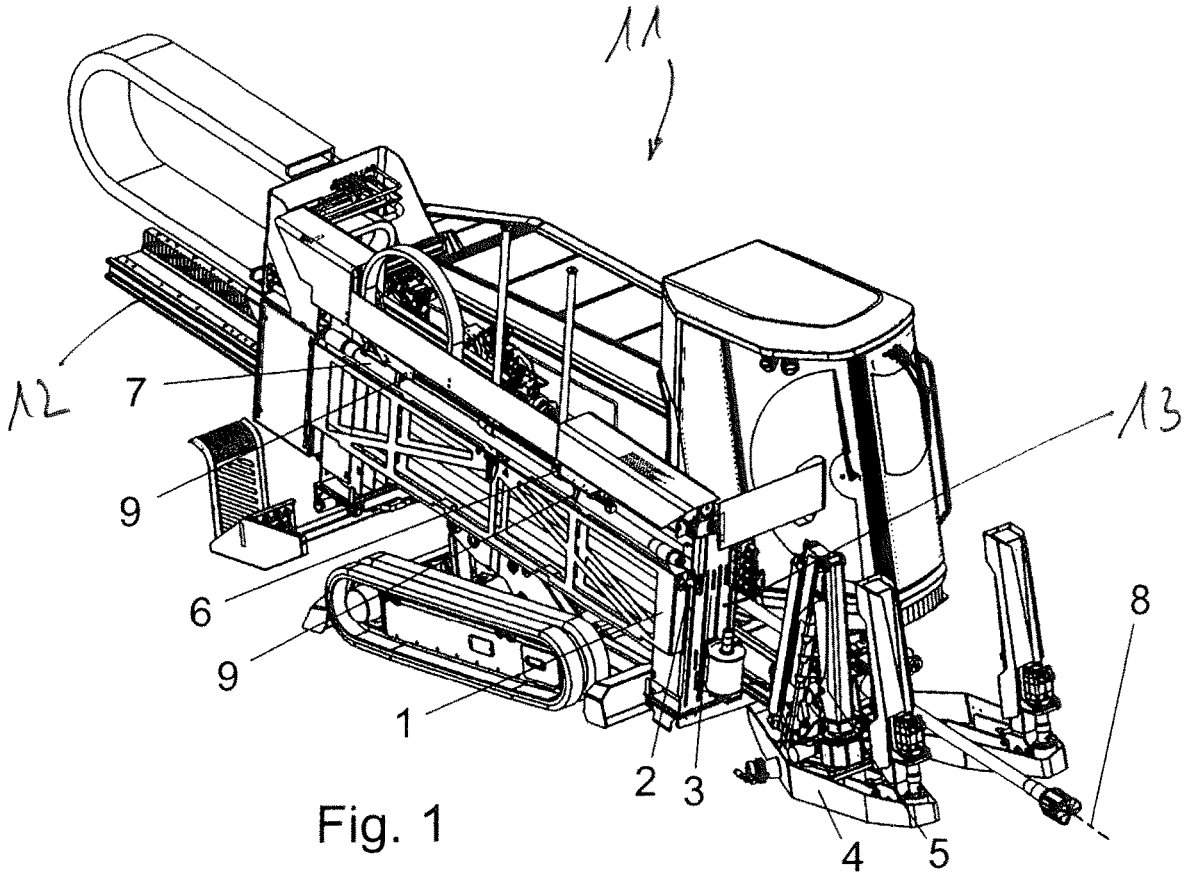
FIG. 1 is a ground drilling device having a first rod magazine and a second rod magazine.

FIG. 1 shows a ground drilling device 11 with which an earth borehole can be made in the soil. The ground drilling device 11 comprises a drilling carriage 12. The drilling carriage 12 defines a drill string axis 8, shown schematically in FIG. 1 in the form of a broken line. Along the drill string axis 8 a drive element or a connection can move, being arranged on or at a sled on the drilling carriage. The drive element or the connection may be connected to rod sections 7, which are arranged in a first rod magazine 3, in order to connect them to the already introduced drill string and drive them into the soil. The first rod magazine 3 comprises separating elements, which extend substantially along the drill string axis 8, offset from it. The separating elements form compartments or rows or columns situated alongside each other in order to hold the rod sections 7. The rod sections 7 can be arranged one above another in the compartments.

In order to take up the rod sections 7 stored or stockpiled in the first rod magazine 3 and transfer them to the drill string axis 8, there is provided a transfer device 6, having two gripping devices 9 with which a rod section 7 can be grasped. The gripping devices 9 can be moved vertically and horizontally, both transversely to and also in the longitudinal direction, parallel to the drill string axis 8.

A guide is arranged on the first rod magazine 3, making possible a horizontal movement of the gripping devices 9. In this way, a rod section 7 can be moved transversely to the drill string axis 8. A guide is connected respectively to each head piece 13 of the first rod magazine 3 at the head end. In the embodiment represented in FIG. 1, there is a direct connection between the guide and the head piece 13. The guide is designed as a linear guide. One end each of a beam, on which the gripping devices 9 are arranged, is led in one of the guides.

For the moving of the gripping devices 9 in the substantially vertical direction, the gripping devices 9 are led movably in height on the beam.

Alongside the first rod magazine 3 there is arranged a second rod magazine 1. The first rod magazine 3 can be connected to the second rod magazine 1 by means of first connection elements 2 formed on the first rod magazine 3. The first connection elements 2 of the first rod magazine 3 are formed by holders which are formed on the first rod magazine 3 at the ends (here, the head pieces 13).

The second rod magazine 1 comprises second connection elements 10, which are formed as locating bolts and by which the second rod magazine 1 can be connected to the first rod magazine 3. The second rod magazine 1 can be suspended by the second connection elements 10 from the first connection elements 2 of the first rod magazine 3. One of the two second connection elements 10 is arranged at its end on one end of the second rod magazine 1. A crane 5 placed on an anchor plate can pick up the second rod magazine 1, as shown in FIG. 2, and move it as well as suspend it from the first rod magazine 3.

The transfer device 6 after the second rod magazine 1 is connected to the first rod magazine 3 can be unlocked for taking rod sections 7 out from the second rod magazine 1 and moving them into the drill string axis 8 (or vice versa), so that the travel path extends transversely to the drill string axis 8 across the second rod magazine 1, there being formed guides on the second rod magazine 1, as are also present in relation to the first rod magazine 3.

A second rod magazine 1 can be connected to the first rod magazine 3 when necessary by using the crane 5 placed on the anchor plate. If there should be a further need for rod sections 7, the then empty second rod magazine 1 can be replaced by or exchanged for a further "second" rod magazine 1 filled with rod sections 7.

Figure 2:
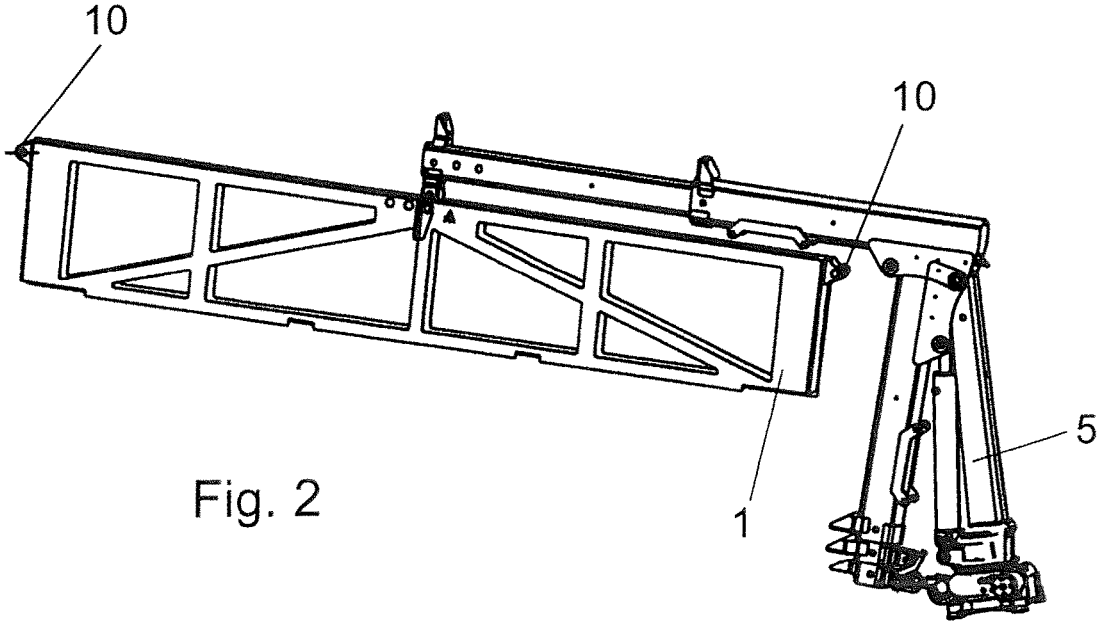
FIG. 2 is a view of the second rod magazine with a crane for lifting and moving the rod magazine.
Figure 3:
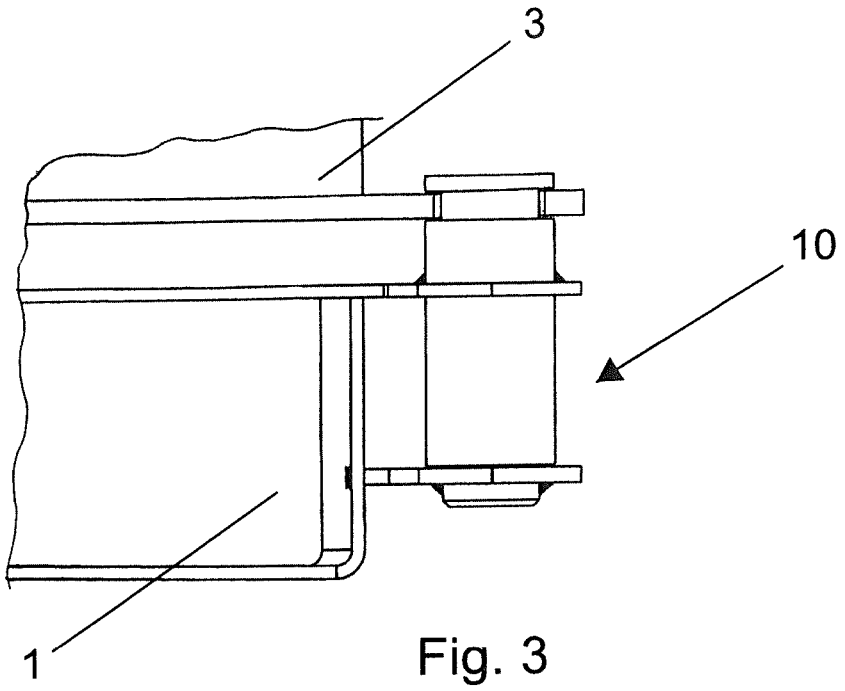
FIG. 3 is a detail top view of FIG. 2.

FIG. 3 shows a detail top view of FIG. 2 in an end region of the first rod magazine 3 and the second rod magazine 1. The second rod magazine 1 is suspended by means of connection elements 10 arranged at its end, being configured as bolts, from fork-shaped brackets as the second connection elements 2 of the first rod magazine 3. The second connection elements 2 are likewise situated at the end in the margin region of the first rod magazine 3. The brackets extend in a direction parallel to the drill string axis, offset from it. The bolts extend transversely to the longitudinal axis of the second rod magazine 1. The bolt, which is designed as the second connection element 10 of the second rod magazine 1, has a recess. By connecting the bolt in the bracket, a fixation in height is possible. The bracket indicates a reference range or reference point for the height. The recess enables a fixation in a position transverse to the drill string axis and thus provides the possibility of a referencing.

The invention claimed is:

1. A ground drilling device for drilling a horizontal borehole comprising:

a drilling carriage, which defines a generally horizontal drill string axis, a first drill rod magazine arranged to store a first plurality of rod sections oriented substantially parallel to the drill string axis, a rod section transfer device configured to transfer a rod section between the first drill rod magazine and a position of the rod section along the drill string axis of the drilling carriage, and at least a first rod magazine connector arranged at the first drill rod magazine and/or at the drilling carriage and adapted to connect the first drill rod magazine to a second drill rod magazine arranged to store a second plurality of rod sections oriented substantially parallel to the drill string axis such that the second drill rod magazine is arranged next to the first drill rod magazine.

2. The ground drilling device according to claim 1, wherein the rod section transfer device configured to transfer the rod section between the first drill rod magazine and the position of the rod section along the drill string axis of the drilling carriage is further configured to move, responsive to a mechanical or electrical actuation, across and transversely to the second drill rod magazine, to access the second drill rod magazine for the transfer of the rod section between the second drill rod magazine and the position of the rod section along the drill string axis of the drilling carriage.

3. The ground drilling device according to claim 1, wherein the first rod magazine connector comprises at least one of a holder, a recess, a protrusion, a bar, a hook, a bolt, or a bracket.

4. The ground drilling device of claim 1, wherein the second rod magazine connector is configured to mechanically interact with the first rod magazine connector to connect the second drill rod magazine to the first drill rod magazine.

5. A system comprising:

a drilling carriage which defines a generally horizontal drill string axis, a first drill rod magazine arranged to store a first plurality of rod sections oriented substantially parallel to the drill string axis, a second drill rod magazine arranged to store a second plurality of rod sections oriented substantially parallel to the drill string axis, a rod section transfer device configured to transfer a rod section between the first drill rod magazine and a position of the rod section along the drill string axis of the drilling carriage, and at least a first rod magazine connector arranged at the first drill rod magazine and/or at the drilling carriage and adapted to connect the first drill rod magazine to the second drill rod magazine such that the second drill rod magazine is arranged next to the first drill rod magazine.

6. The system according to claim 5, wherein the second drill rod magazine has a spatial extension transverse to the longitudinal axis and configured to hold one or two rod sections next to each other.

7. The system according to claim 5, wherein the second drill rod magazine comprises a second rod magazine connector configured to mechanically interact with the first rod magazine connector.

8. The system according to claim 5, further comprising a crane for moving the second drill rod magazine.

9. A method for earth drilling comprising:

arranging a drilling carriage to define a generally horizontal drill string axis, storing, in a first drill rod magazine, a first plurality of rod sections oriented substantially parallel to the drill string axis, transferring, by a rod section transfer device, a rod section between the first drill rod magazine and a position of the rod section along the drill string axis of the drilling carriage, connecting, by a first rod magazine connector arranged at the first drill rod magazine and/or at the drilling carriage, a second drill rod magazine adapted to store a second plurality of rod sections oriented substantially parallel to the drill string axis next to the first drill rod magazine, and transferring, by the rod section transfer device, a rod section between the second drill rod magazine and a position of the rod section along the drill string axis of the drilling carriage.

10. The method of claim 9, further comprising enabling the rod section transfer device to move beyond the original limitation of movement of the transfer device to access the first drill rod magazine such that the rod section transfer device moves transversely to access the second drill rod magazine for transferring the rod section between the second drill rod magazine and the position of the rod section along the drill string axis of the drilling carriage.

11. The method of claim 9, further comprising connecting a plurality of second drill rod magazines to the first rod magazine connector to connect a succession of second drill rod magazines to the first drill rod magazine.

12. The method of claim 9, wherein connecting the first rod magazine connector arranged at the first drill rod magazine and/or at the drilling carriage to the second drill rod magazine comprises connecting the first rod magazine connector to a second rod magazine connector on the second drill rod magazine.

13. A ground drilling device comprising:

a drilling carriage, which defines a drill string axis, a first drill rod magazine arranged to store a first plurality of rod sections, a rod section transfer device configured to transfer a rod section between the first drill rod magazine and a position of the rod section along the drill string axis of the drilling carriage, and at least a first rod magazine connector arranged at the first drill rod magazine and/or at the drilling carriage and adapted to connect the first drill rod magazine to each of a plurality of second drill rod magazines arranged to store a plurality of rod sections such that each of the plurality of second drill rod magazines is arranged in succession next to the first drill rod magazine.

14. The ground drilling device of claim 13, wherein the first drill rod magazine is arranged to store the first plurality of rod sections oriented substantially parallel to the drill string axis, and wherein the second drill rod magazine is arranged to store the second plurality of rod sections oriented substantially parallel to the drill string axis.

15. The ground drilling device of claim 13, wherein the rod section transfer device configured to transfer the rod section between the first drill rod magazine and the position of the rod section along the drill string axis of the drilling carriage is further configured to be enabled to move beyond the original limitation of movement of the transfer device to access the first drill rod magazine such that the rod section transfer device moves transversely to access the second drill rod magazine for the transfer of the rod section between the second drill rod magazine and the position of the rod section along the drill string axis of the drilling carriage.

16. The ground drilling device of claim 13, wherein the first rod magazine connector comprises at least one of a holder, a recess, a protrusion, a bar, a hook, a bolt, or a bracket.

17. A ground drilling device comprising:

a drilling carriage, which defines a drill string axis, a first drill rod magazine arranged to store a first plurality of rod sections, and a rod section transfer device configured to transfer a rod section between the first drill rod magazine and a position of the rod section along the drill string axis of the drilling carriage, and at least a first rod magazine connector arranged at the first drill rod magazine and/or at the drilling carriage and adapted to connect the first drill rod magazine to a second drill rod magazine such that the second drill rod magazine is arranged next to the first drill rod magazine;

wherein the rod section transfer device configured to transfer the rod section between the first drill rod magazine and the position of the rod section along the drill string axis of the drilling carriage is further configured to be enabled to move beyond the original limitation of movement of the transfer device to access the first drill rod magazine such that the rod section transfer device moves transversely to access the second drill rod magazine for the transfer of the rod section between the second drill rod magazine and the position of the rod section along the drill string axis of the drilling carriage.

18. The ground drilling device of claim 17, wherein the first drill rod magazine is arranged to store the first plurality of rod sections oriented substantially parallel to the drill string axis, and wherein the second drill rod magazine is arranged to store the second plurality of rod sections oriented substantially parallel to the drill string axis.

19. The ground drilling device of claim 18, wherein the at least first rod magazine connector is configured to connect the first drill rod magazine to each of a plurality of second drill rod magazines arranged to store a plurality of rod sections such that each of the plurality of second drill rod magazines is arranged in succession next to the first drill rod magazine.

20. The ground drilling device of claim 18, wherein the rod section transfer device comprises a movable grip configured to grip the rod section in the first drill rod magazine and position the rod section along the drill string axis of the drilling carriage.

* * * * *